United States Patent [19]

Pearson

[11] 4,334,443

[45] Jun. 15, 1982

[54] TORQUE STABILIZED WATER METER WRENCH

[76] Inventor: Bernard E. Pearson, 16445 9th SW., Seattle, Wash. 98166

[21] Appl. No.: 119,220

[22] Filed: Feb. 7, 1980

[51] Int. Cl.[3] ..... B25B 13/00

[52] U.S. Cl. ..... 81/55; 81/90 R

[58] Field of Search ..... 81/55, 56, 90 R, 90 B, 81/90 E, 90 F, 90 C, 125, 119, 180 R, 177 R; 248/229; 16/110.5; 254/DIG. 3

[56] References Cited

U.S. PATENT DOCUMENTS

| | | | |
|---|---|---|---|
| 970,371 | 9/1910 | Greggs | 81/90 C |
| 2,116,770 | 5/1938 | Scillia | 137/13 |
| 2,937,657 | 5/1960 | Miller et al. | 137/328 |
| 3,010,346 | 11/1961 | Kulp | 81/90 |
| 3,014,389 | 12/1961 | O'Hara | 81/90 D |
| 3,086,414 | 4/1963 | Nardi | 81/90 |
| 3,113,599 | 12/1963 | Trotter | 248/229 |
| 3,119,290 | 1/1964 | Irie | 81/90 B |
| 3,156,141 | 11/1964 | Pluntz | 81/53 |
| 3,313,508 | 4/1967 | Mand | 248/229 |
| 3,840,041 | 10/1974 | McMurray | 137/296 |
| 3,891,181 | 6/1975 | Sanders | 81/56 |

*Primary Examiner*—James L. Jones, Jr.

*Attorney, Agent, or Firm*—Gregory W. Moravan; Roy E. Mattern, Jr.; David H. Deits

[57] ABSTRACT

A water meter wrench adapted to loosen or tighten the meter's box ring or its equivalent while the meter is in its installed location - usually below the ground in a meter box. The wrench comprises a tubular main stem having a torque stabilizing bar attached to its upper end and a pair of water meter engaging forks attached to a support at its lower end, the distance between the forks being selectively adjustable. Within the tubular main stem is carried a socket drive shaft having a head at its upper end and a box ring engager at its lower end. In use, the box ring is engaged by the engager, the separation between the water meter forks is adjusted for the size of the meter, and the forks are engaged with the inlet and outlet portions of the meter. Next, the socket drive shaft is torqued in the desired direction, as with a socket or torque wrench, the drive shaft in turn torquing the box ring engager and hence the box ring. Simultaneously with the application of torque to the box ring, an opposing torque is applied to the torque stabilizing bar, which in turn torques the main stem, the water meter engaging forks, and finally the body of the water meter. Despite the torquing of the box ring, this opposing torque prevents any turning of the water meter which might otherwise damage the meter, its water lines, or its connections.

14 Claims, 3 Drawing Figures

TORQUE STABILIZED WATER METER WRENCH

SUMMARY OF THE INVENTION

As is well known, even the best quality and most durable water meters made occasionally need repair when, for whatever reason, the meter mechanism they contain fails to give accurate readings or even fails to read at all. When it is recalled that there are millions of water meters in service in the United States, if there is only a one percent failure rate per year, that equals ten thousand failures per year for every one million installed meters a staggering number of failures to repair.

In order to put this repair problem into perspective, some background information is needed as to the construction of many water meters and how they are installed. A typical modern water meter, such as the Corad multi-jet cold water meter model CM-3 produced by the Corad Corporation of Miami, Florida, uses a replaceable meter cartridge which is retained and sealed within the meter body by a lugged box ring.

Of course, the mentioned construction of the Corad meter is specifically understood to be by way of nonlimiting example only. For it is possible that some brands of water meters presently in use or which may be developed in the future will not use a box ring, but may use some other form of cap or cover serving the same purpose, or may even thread the meter cartridge or its equivalent directly into the meter body.

Thus, the word box ring as used herein is defined to mean not only the box ring shown in the figures by way of example, but also means any other form of torqued cap or cover serving the same purpose—to retain and seal the meter mechanism within the meter body or to provide access to the interior of the meter body.

Similarly, although the box ring illustrated in the figures has lugs adapted to be engaged so it may be torqued, and the box ring engager has corresponding recesses to engage the lugs, the word lug is defined herein to also include any other means provided on the box ring so it may be torqued, such as slots, and the word recess as used to describe the box ring engager is defined herein to also include any other corresponding means used to engage the lug, such as prongs which engage said slots.

Turning again to the Corad meter by way of example, in order to adequately retain and seal the meter cartridge against the entry of dirt or moisture, the box ring is torqued down quite heavily. For example, for the Corad meter mentioned above, the manufacturer's recommended torque specification is seventy-five foot-pounds. An equal, or even greater torque if dirt or corrosion clogged the threads, would, of course, be required to loosen the box ring so the meter cartridge could be removed for repair or replacement.

Such torquing of the box ring is, of course, quite easily done in the shop. However, a much different problem is presented if one wishes to torque the box ring while the meter is in its installed location and is connected to its associated water lines. As will readily be appreciated, a torque applied to the box ring will also cause the water meter body to twist or rotate. At the torques required to adequately tighten or loosen the box ring, the twisting force imparted to the water meter body is sufficient, in some cases, to stress, kink or break the water lines connected to the meter, damage, stress or loosen the connections between the meter and its associated water lines, or even damage the water meter itself.

As a result, when the meter mechanism within the water meter malfunctioned and needed repair, it was often necessary to shut off the water supply, disconnect the defective water meter from its associated water lines, install a working water meter, connect the working meter to the water lines, turn the water supply back on, and take the failed water meter to the shop where it could be disassembled, then repaired and reassembled. In addition, since water meters are often kept track of by their serial number and their water consumption billed to the consumer with that serial number, the laborious changing of the serial numbers recorded in the water supplier's records was also required. Clearly, the forgoing process is quite time consuming and expensive.

Thus, the primary object of the present invention is to avoid the above described time consuming and expensive process by providing a torque stabilized wrench suitable for torquing, i.e. loosening and removing, as well as installing and tightening, the box ring on a water meter while simultaneously preventing any substantial twisting or turning of the water meter body which might damage the meter itself, or which might damage, kink or break the meter's associated water lines, or their connections with the water meter; thereby enabling the water meter to be disassembled, repaired, and reassembled in its installed location while it is still connected to its associated water lines.

This primary object is achieved by the basic form of the invention which comprises drive means for engaging and torquing the box ring in a first direction, and means which rotatably carry said drive means and which are for engaging and torquing the water meter body in a second direction opposed to said first direction. In use, as the drive means are being torqued to in turn torque the box ring, an opposing and equal torque is applied to the means for engaging the water meter body thereby holding the meter body substantially stationary and preventing damage to the water meter, its inlet and outlet connections, or the water lines connected thereto.

As is well known, many water meters for domestic use are located outside the dwelling below ground level in a water meter box, or are located in other inaccessible locations. It is, as a result, difficult to work on water meters so installed because of their hard to reach locations, and so another object of the present invention to provide a torque stabilized water meter wrench which will also be useable on such hard to reach water meters.

This object is at least partially achieved by providing an elongated drive shaft in the drive means and an elongated main stem in the means for engaging the water meter body thereby enabling the wrench to conveniently engage the box ring and the water meter body while the upper end of the wrench protrudes above ground level a sufficient distance to enable the user to conveniently operate it.

Since the size of the box ring and the form and arrangement of the engaging means thereon, such as its lugs, will differ on different water meters, it is another object of the present invention to provide a torque stabilized wrench which can be easily adapted to engage whatever particular form of box ring is encountered by the user. This object is at least partially achieved by the present invention which may provide a socket attached to the lower end of the drive shaft in the drive means, and a drive head on each different box ring engager adapted to be received by the socket. Thus, for any particular box ring encountered, the user simply inserts the drive head of the appropriate box ring engager into the socket, and the wrench is ready to use.

In order to provide a low cost, durable torque stabilized wrench it is preferred that the drive shaft be an ordinary socket shaft having a head engageable by any conventional socket or torque wrench, while the socket is a conventional socket which is snapped on or set screwed on the drive tip of the socket shaft.

Since the size and shape of the water meter body will differ on different water meters, it is another object of the present invention to provide means for engaging the meter body which are adjustable. This object is at least partially achieved by providing a pair of water meter body engaging forks wherein the distance between the forks can be selectively varied. In some forms of the invention the distance is varied by providing that the means for engaging the meter body include a forks support having a pair of slots through which bolts extend to secure the forks to the forks support. Then by merely loosening the bolts, the distance between the forks can be varied, after which the bolts are tightened to lock the forks in place.

The object of providing greater leverage for the user is achieved by providing a main stem in the means for engaging the meter body, which means may also include a stabilizing bar attached to said main stem so the user can increase his torque on the main stem by the leverage provided by the stabilizing bar.

Some aspects of the present invention provide an unusually compact and convenient to use torque stabilized wrench. This may be done by providing a tubular main stem in the means for engaging the meter body, and providing for the drive shaft to extend through and be carried by the tubular main stem.

Compactness is also achieved by providing that the stabilizing bar is demountable from its working position on the main stem and by providing a clip on the main stem for holding the bar adjacent to and parallel to the main stem in a compact storage configuration.

Compactness is further achieved by providing that the forks which engage the meter body be removeable from their working position on the forks' support, and secured in a compact storage position wherein the main portion of the forks are located adjacent to and parallel to the main stem.

It is to be understood that the forgoing is but a brief summary, not a detailed catalogue, of some of the objects and features of the present invention, and is not to be taken as a limitation on the scope of the present invention. The scope of the invention is to be construed to include all of the features and benefits inherent in the disclosed invention, whether or not specifically mentioned anywhere herein.

DESCRIPTION OF THE PREFERRED EMBODIMENTS

Before describing the particular construction of the torque stabilizing water meter wrench of the present invention, a description of the water meter with which it is adapted to be used will first be given. It is to be understood that the water meter illustrated in the figures is by way of non limiting example since the present invention is addressed to a torque stabilized wrench for disassembling and reassembling water meters, and is not addressed to any particular water meter per se.

Figure 2:
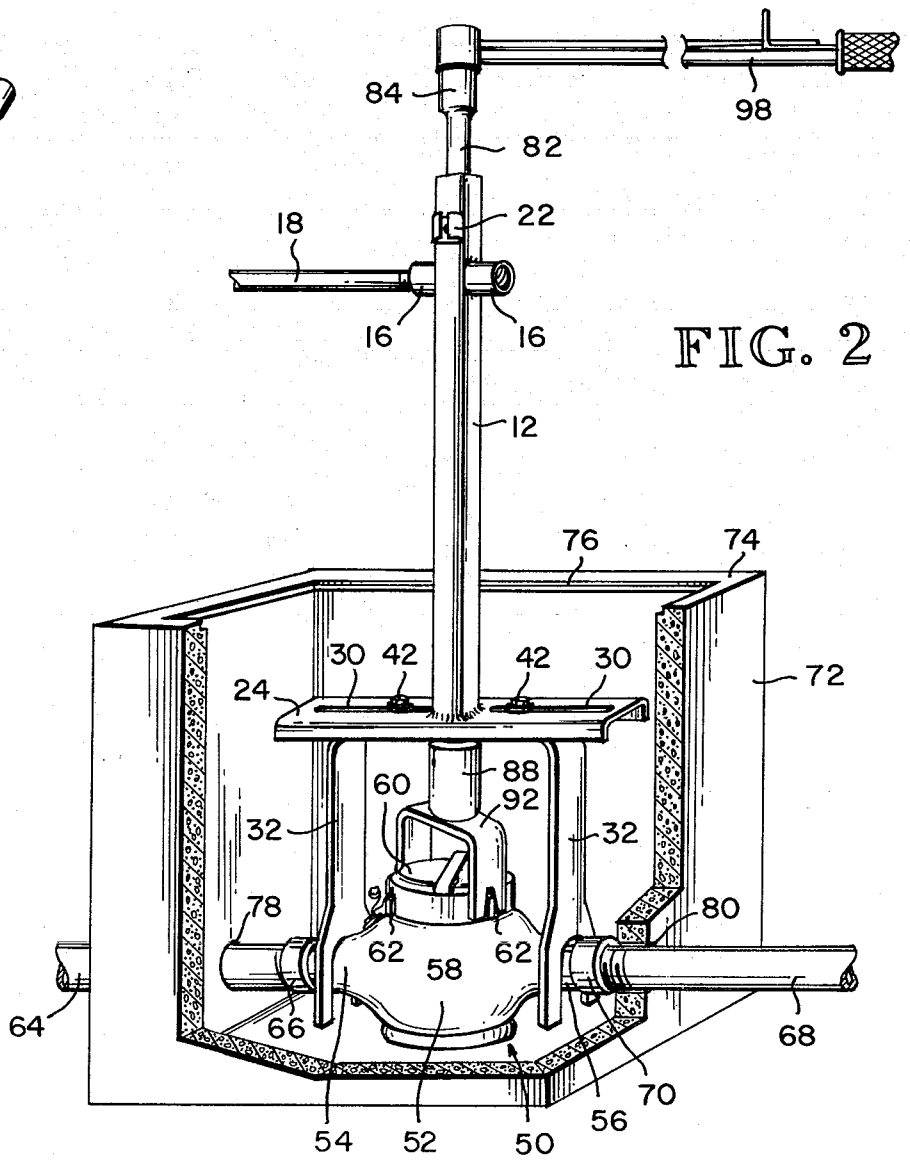
FIG. 2 is a perspective view of the wrench being applied to a typical water meter installed in a typical water meter box.

Referring now to FIG. 2, the water meter, generally designated at 50, comprises a meter body 52 having an inlet portion 54 and an outlet portion 56. Threadedly connected to the top portion of the body 52 is a box ring or cap 58 having a hinged cover 60 and a plurality of lugs or ears 62 adapted to be engaged when torquing, i.e. when tightening or loosening, the box ring 58. Within the meter are metering means, not illustrated, which may be in the form of a replaceable meter cartridge, for measuring the amount of water flowing through the meter. Access to the metering means is provided by removal of the box ring 58 which normally retains and seals the metering means within the water meter body 52, or provides access to the metering means within the meter body.

When installed, the meter 50 has a water supply line 64 connected to its inlet portion 54 with a connection 66, and a water delivery line 68 connected to its outlet portion 56 with a connection 70. Although the water meter 50 will be found installed in a variety of locations, it is frequently found installed in a water meter box 72 whose top portion 74 is usually located at or slightly above ground level, meaning the meter 50 is normally located below ground level for protection from freezing. The box 72 has a top opening 76 through which the water meter 50 can be installed, removed, or read after a cover, not illustrated, which fits into the opening 76 is removed. As seen, the water supply and delivery lines 64, 68 pass through openings 78, 80 in the side walls of the meter box.

Figure 1:
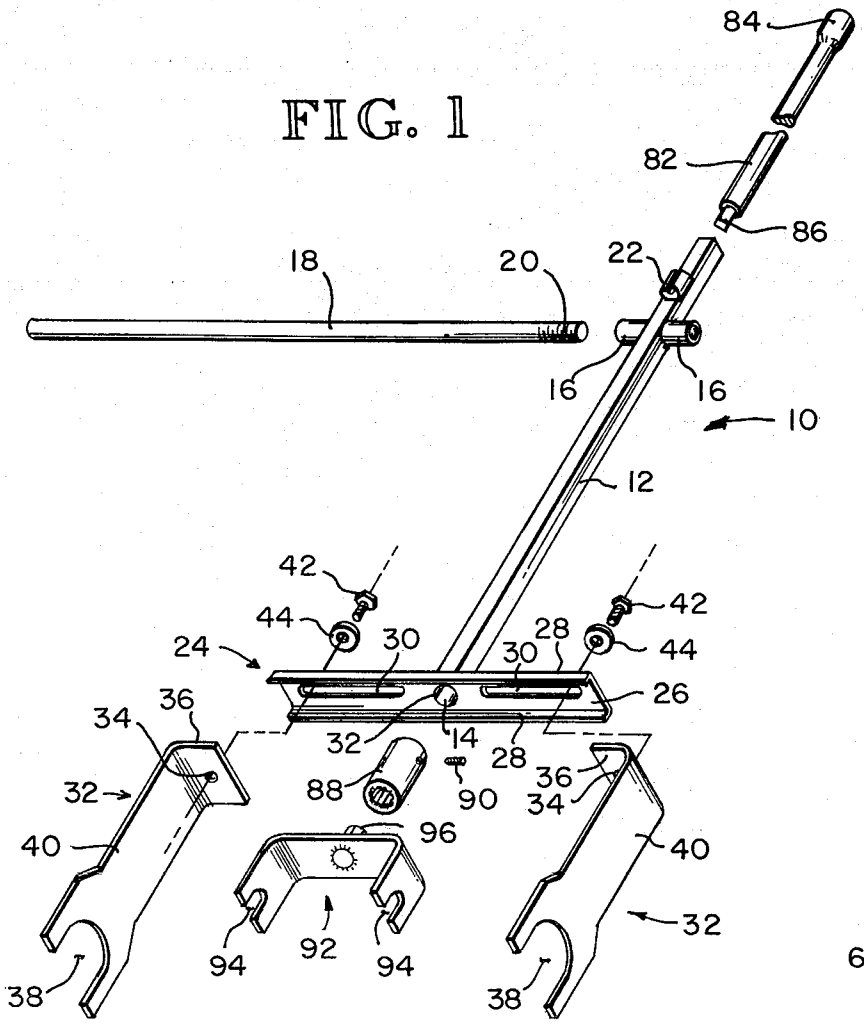
FIG. 1 is an exploded perspective view of the torque stabilized water meter wrench of the present invention.

Referring now to FIG. 1, the torque stabilized water meter wrench of the present invention is shown generally designated at 10. The wrench includes a tubular main stem 12 having a bore 14 extending therethrough. Although the main stem is shown having an outer surface of square cross sectional configuration, it is to be understood that the outer surface of the main stem could take other configurations such as oval or circular. At the upper end of the main stem are located a pair of mounts 16, although a larger or smaller number of mounts could be utilized. Each mount preferably comprises a short segment of steel pipe which is threaded internally, each mount being affixed to the main stem as by welding.

Figure 3:
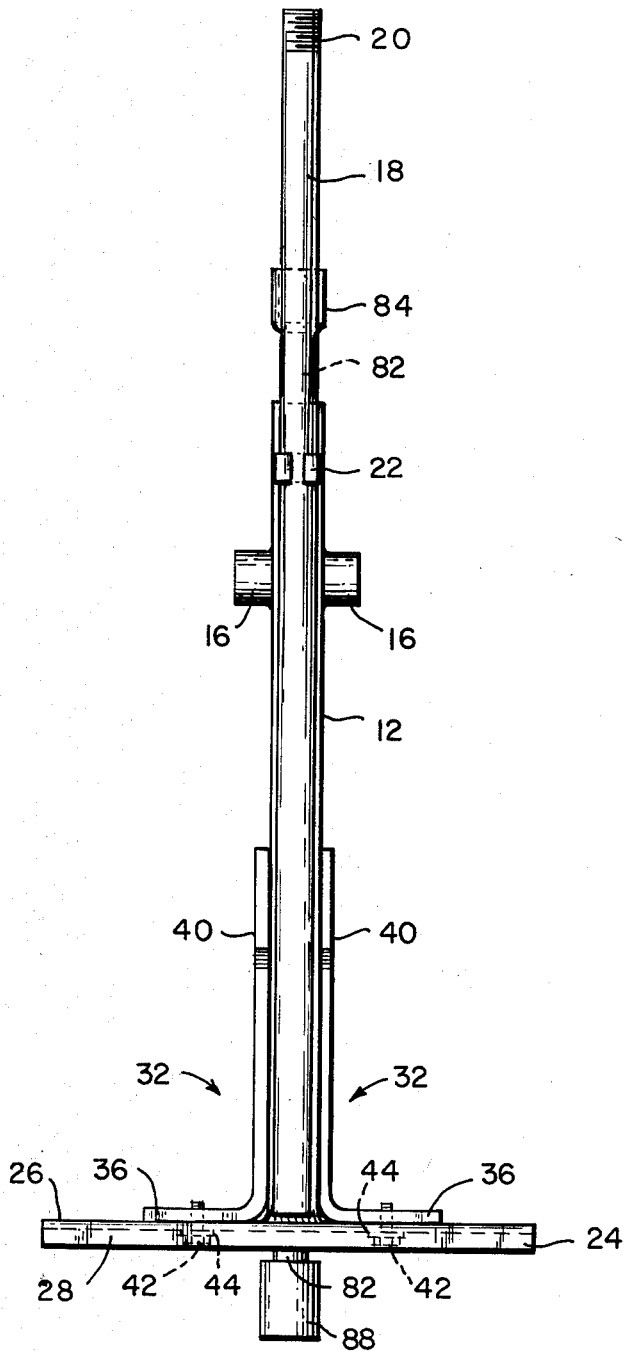
FIG. 3 is a side elevational view showing the wrench in its compact storage or shipping configuration.

A stabilizing bar 18, whose use will be described subsequently, has threads 20 at one end thereof adapted to be engaged with the threads in the mounts 16. Also affixed to the upper end of the main stem 12 is a clip 22 which is used to hold the stabilizing bar 18 parallel to and adjacent to the main stem in a compact storage position, as best seen in FIG. 3. Although a conventional spring clip 22 is illustrated, any suitable releaseable fastening means could be utilized to achieve this same purpose.

At the lower end of the main stem 12 is a forks support, generally designated at 24, which preferably comprises a length of U-channel steel having a web 26 and flanges 28. Preferably, the support 24 is affixed to the main stem, as by welding its web 26 thereto. The web 26 defines a pair of elongated slots 30 as well as a hole 32 aligned with the bore 14 in the tubular main stem 12.

The wrench 10 includes a pair of L-shaped forks 32. Each L-shaped fork has a mounting hole 34 in its foot 36 and a water meter recess 38 in its leg 40 which is sized to fit over the inlet or outlet portion 54, 56 of the water meter. During use, as best seen in FIG. 2, the feet of the forks are mounted to the lower surface of the web 26 by a pair of bolts 42 and washers 44. As will be appreciated, when the bolts are relatively loose the distance between the forks can be adjusted so the forks will accommodate a variety of sizes of water meters. Although it is preferred that the forks be so adjustable, it is possible that the forks could be non adjustable and affixed to the support 24 or even to the stem 12.

Referring again to FIG. 1, the bore 14 in the main stem 12 carries a drive shaft 82 which is preferably a conventional socket drive shaft having a head 84 at its upper end and a drive tip 86 at its lower end, although any suitable equivalent having means for being engaged at one end and means for engaging at the other end would also work. A socket 88 is secured to the drive tip, as by set screw 90.

A box ring engager, generally designated at 92, is provided having a pair of box ring recesses 94. The engager 92 is dimensioned and the recesses 94 are sized so that when the engager 92 is placed over the box ring 58 as shown in FIG. 2, the recesses 94 will engage at least one of the lugs 62 on the box ring 58.

Since the arrangement of lugs on the box ring as well as their size may differ according to the manufacturer, it is preferred that the box ring engager 92 include a drive head 96 adapted to be engaged by the socket 88 so that box ring engagers of different sizes and configurations could be readily substituted depending on the type of box ring 58 encountered by the user.

However, of course, if such flexibility was not desired it is possible for the box ring engager 92 to be affixed, as by welding to the lower end of the drive shaft 82, thereby eliminating the need for the drive shaft to be a conventional socket drive shaft and also eliminating the need for the socket 88 and set screw 90.

It will also be apparent that other forms of the box ring engager 92 besides that illustrated could be utilized without departing from the scope of the present invention. For example, the engager 92 could be cylindrical in form having like recesses 94 spaced about its periphery. Similarly, depending on the construction of the particular box ring 58 encountered it is possible that other means for tightening and loosening the box ring 58 besides the lugs 62 might be encountered. If such is the case, the fabrication of a box ring engager 92 adapted to engage whatever engageable means are provided on the box ring encountered will readily occur to those skilled in the art in view of the disclosures herein.

Similarly, if a water meter should utilize no box ring 58, but instead should have its metering means threaded directly into the meter body 52, a suitable equivalent for the box ring engager 92 could be provided to engage such a metering means in view of the disclosures herein.

By way of example, for the embodiment of the invention shown in the figures, the main stem 12 is about 16 inches long, the drive shaft 82 is about 20 inches long, the support 24 is about 10 inches long, the slots 30 therein are about 3½ inches long, the legs 40 on the forks 32 are about 7¼ inches long, the feet 36 are about 2 inches long, the stabilizing bar is about 2 feet long, and the box ring engager is about 2½ inches long.

Referring once again to FIG. 2, a description of the operation and manner of use of the torque stabilized wrench 10 of the present invention will now be given. First, the box ring engager 92 is placed over the box ring 58 so that the engager's recesses 94 engage the lugs 62 on the box ring. Next, the wrench 10 is positioned over the water meter so that the socket 88 at the lower end of the drive shaft 82 engages the drive head 96 on the top of the box ring engager 92.

Then the bolts 42 are loosened so that the distance between the forks 32 may be adjusted so that the recesses 38 in the forks will conveniently fit over the inlet and outlet portions 54, 56 of the water meter 50, and the bolts 42 are then tightened with the forks 40 in place over the water meter as shown. After this, the stabilizing bar 18 is screwed into the most convenient mount 16 and a conventional socket or torque wrench 98 is engaged with the drive shaft head 96.

Next, the socket or torque wrench 98 is used to torque the drive shaft 82, socket 88, and box ring engager 92, which in turn torque the box ring 58 in the desired direction. At the same time that torque is being applied to the box ring 58, the stabilizing bar 18 is used to apply an opposite and equal torque to the mount 16, stem 12, support 24 and forks 32, which in turn torque the meter body 52, thereby holding the water meter stationary despite the torquing of the box ring.

This, as has been described prevents any turning of the water meter body and hence prevents any damage to the water meter 50, its water lines 64, 68 or its connections 66, 70.

As will be appreciated from the forgoing description, to loosen or remove a right hand threaded box ring 56, the socket or torque wrench 98 is torqued in a counterclockwise direction while the stabilizing bar 78 is torqued in a clockwise direction. Similarly, to install and tighten the box ring 58, the socket or torque wrench 98 is torqued in a clockwise direction while the stabilizing bar 18 is torqued in a counterclockwise direction.

It should be noted in passing that the stabilizing bar 18 could be eliminated and the main stem 12 could be engaged by an ordinary hand held wrench which was sized to engage the square main stem, but this is not preferred since such an arrangement would likely be less convenient to use.

Referring now to FIG. 3, a description of how the torque stabilized water meter wrench 10 of the present invention can be assembled in a compact storage position will now be given. In order to achieve the compact storage configuration shown in FIG. 3 from the working configuration shown in FIG. 2, the stabilizing bar 18 is unscrewed from its mount 16 and clipped in place lengthwise, parallel to and adjacent to the main stem 12 by use of the clip 22.

Then, the bolts 42 are removed, freeing the forks 32 which may then be positioned with their feet 36 adjacent the top surface of the support 24 and with their legs 40 adjacent to and parallel to the sides of the main stem 12. The bolts 42 are then reinserted into the mounting holes 34 in the feet 36 of the forks 32 from the underside of the support 24 and tightened.

As will be appreciated, when the wrench 10 of the present invention is arranged as shown in FIG. 3, an unusually compact and convenient storage configuration is achieved which may not only save space in the user's tool box or vehicle, but which may also reduce shipping costs by the manufacturer of the wrench 10 since it may be placed in a smaller box than if it was transported in its working configuration shown in FIG. 2.

From the forgoing description of the preferred embodiments of the torque stabilized water meter wrench of the present invention, various further applications, modifications and adaptations of the wrench will be apparent to those skilled in the art to which the invention is addressed, within the scope of the following claims.

What is claimed is:

1. A torque stabilized wrench for the disassembly and reassembly of water meters without requiring the removal of said water meter from its installed location, usually in a meter box below ground level, wherein said water meter is of the general type having:

a water meter body means having meter inlet and outlet means secured by connections to a water supply line and water delivery line, respectively;

metering means within said meter body for metering the water passing through said water meter; and box ring means secured to said meter body means by a torqued connection means, said box ring means being for providing access to said metering means;

wherein said torque stabilized wrench comprises:

drive means for engaging and torquing said box ring means in a first direction;

means which rotatably carry said drive means and which are for engaging and torquing the meter body in a second direction opposed to said first direction;

wherein said means for engaging and torquing the meter body include a pair of forks which define a pair of meter body recesses adapted to fit over and engage said meter body adjacent said meter inlet and outlet means, and further include a main stem and a support means which extends generally transversely with respect to said main stem and which defines a pair of elongated slots adapted to receive fastener means therethrough, said fastener means selectively and adjustably mounting said forks to said support means to enable the distance between said forks to be selectively adjusted to engage different sizes of water meter bodies; and wherein during use of said wrench when the user torques said drive means in said first direction to in turn torque said box ring means in said first direction, the user simultaneously torques said means for engaging the meter body in said second direction to in turn torque said meter body in said second direction to prevent any significant rotation of said meter body, thereby preventing damage to said water meter, said water supply and delivery lines, and said connections during the torquing of the box ring while said meter is connected to said water supply and delivery lines.

2. The wrench according to claim 1, wherein said means which rotatably carry said drive means includes an elongated main stem; and wherein said drive means comprises:

a. a box ring engager means;

b. a conventional socket for a socket wrench; and c. a conventional, elongated drive shaft for a socket wrench;

wherein said drive shaft is adapted to extend through said main stem with its head extending above the top of the main stem and its drive tip extending below the bottom of the main stem; wherein said socket is adapted to be secured to said drive tip; wherein said box ring engager means is adapted to be secured to said socket; wherein said head of said drive shaft is adapted to be engaged by a conventional socket wrench; and wherein when a conventional socket wrench is applied to the head of said drive shaft said box ring means are torqued by means of said drive shaft, socket and box ring engager means.

3. The wrench according to claim 1, wherein said box ring means is of the type having a plurality of lugs spaced about its periphery and said drive means include a box ring engager means having at least one box ring recess sized to engage said lugs.

4. The wrench according to claim 1, wherein said means for engaging the meter body include a main stem and a stabilizing bar secured to said main stem to enable the user to increase his leverage when torquing said main stem to in turn torque said meter body in said second direction to prevent significant rotation of said meter body when said box ring is being torqued by said drive means in said first direction.

5. The wrench according to claim 4, wherein said main stem includes at least two mounting means with which said stabilizing bar can be selectively mounted to said main stem in a direction most convenient to the user while he is using said wrench.

6. The wrench according to claim 4, wherein said main stem includes a stabilizing bar fastening means for holding said stabilizing bar in a compact storage position with its length adjacent to and parallel to said main stem.

7. The wrench according to claim 1, wherein said means for engaging said meter body includes a main stem, and said main stem and said drive means are elongated, to enable said wrench to be utilized with water meters installed in inaccessible places, such as below ground in a water meter box.

8. The wrench according to claim 1, wherein said means for engaging the meter body includes a tubular main stem and at least a portion of said drive means passes through said tubular main stem.

9. The wrench according to claim 1, wherein said means for engaging the meter body define a pair of meter body recesses adapted to fit over and engage said meter body adjacent said meter inlet and outlet means.

10. The wrench according to claim 9, wherein said means for engaging the meter body include a pair of forks which define said pair of meter body recesses.

11. The wrench according to claim 10, wherein said means for engaging the meter body includes support means, and said forks are selectively, adjustably mounted to said support means to enable the distance between said forks to be adjusted to engage different sizes of water meter bodies.

12. The wrench according to claim 1, wherein said support means comprises a length of U-channel steel having a web and a pair of opposed flanges, said slots are defined by said web, and said web is secured to said main stem.

13. The wrench according to claim 1, wherein each of said forks is generally L-shaped, the foot of the L is secured to said support means by said fastener means passing through said slot, and the leg of the L defines said meter body recess.

14. The wrench according to claim 13, wherein said fastener means are removable, enabling said forks to be moved between an operating position in which the feet of said L's are secured to the bottom of the support means; and a compact, storage position in which the feet of said L's are secured to the top of said support means with the legs of said L's located adjacent and parallel to said main stem.

* * * * *